United States Patent [19]

Chen

[11] Patent Number: 4,990,116

[45] Date of Patent: Feb. 5, 1991

[54] COMBINING STRUCTURE FOR TOY BLOCKS

[76] Inventor: Tsan L. Chen, 14, Hsin Ping Rd., An Ping Industrial Zone, Tainan City, Taiwan

[21] Appl. No.: 371,119

[22] Filed: Jun. 26, 1989

[51] Int. Cl.[5] ..... A63H 33/08

[52] U.S. Cl. ..... 446/124; 52/284; 52/594

[58] Field of Search ..... 446/124, 125, 117, 120, 446/128, 85; D21/108; 52/594, 591, 284, 405

[56] References Cited

U.S. PATENT DOCUMENTS 1,902,136 3/1933 Mills ..... 446/124

2,911,818 11/1959 Smith ..... 446/125 X 3,220,141 11/1965 Goss, III ..... 446/124

FOREIGN PATENT DOCUMENTS 477823 2/1953 Italy ..... 448/128

*Primary Examiner*—Mickey Yu

*Attorney, Agent, or Firm*—Fleit, Jacobson, Cohn, Price, Holman & Stern

[57] ABSTRACT

A combining structure for toy blocks, forming a cross-shaped tenon on the top surface of a single unit block and mortises in the bottom surface of the single unit block, the unit blocks able to be combined together one by one inserting the tenon of a block in the mortises of another block.

1 Claim, 4 Drawing Sheets

COMBINING STRUCTURE FOR TOY BLOCKS

BACKGROUND OF THE INVENTION

Conventional toy blocks, "Lego" for example, are combined together one by one, by inserting protruding round posts on the top surface of a block in a round-holed protruding wall on the bottom surface of another block. The blocks are generally made of plastics, and the walls are liable to break and wear out because of their material so that blocks combined together often cannot hold tight together or can break, obliging a player to supplementally buy some blocks more.

SUMMARY OF THE INVENTION

The object of this invention is to provide a toy block having a cross-shaped tenon on the top surface of each square unit block and to from a mortise in the bottom surface of the four side walls of each square block, and said mortises can be tightly stuck in by the cross-shaped tenon. Besides, the central lines of the mortises can lap over those of the tenon and cross each other at the very center of the block. So the blocks can be combined together with one by one, with the tenons tightly sticking in the mortises.

BRIEF DESCRIPTION OF THE DRAWINGS

This invention will now be described in detail with reference to accormpanying drawings wherein.

DETAILED DESCRIPTION OF THE INVENTION

Figure 1:
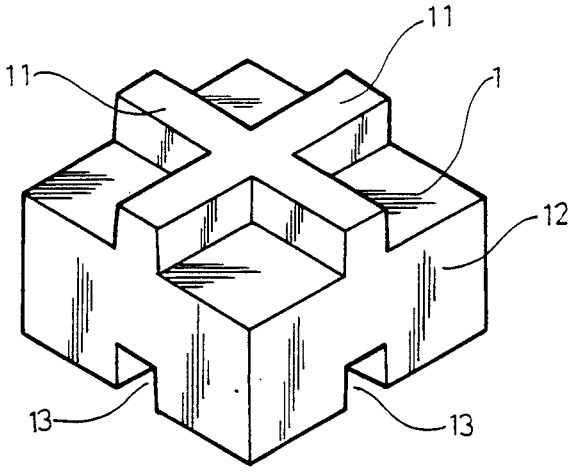
FIG. 1 is a perspective view of a single unit block in accordance with the present invention.
Figure 2:
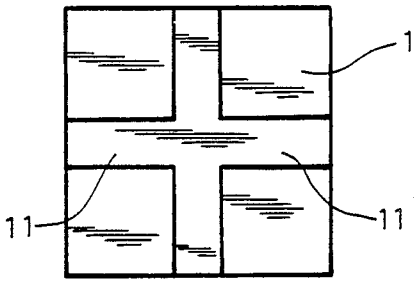
FIG. 2 is an upside view of a single unit block in accordance with the present invention.
Figure 3:
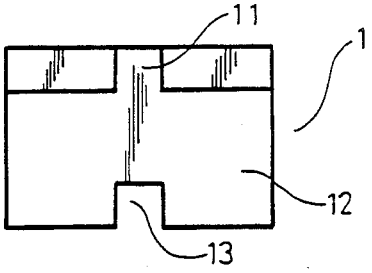
FIG. 3 is a front view of a single unit block in accordance with the present invention.
Figure 4:
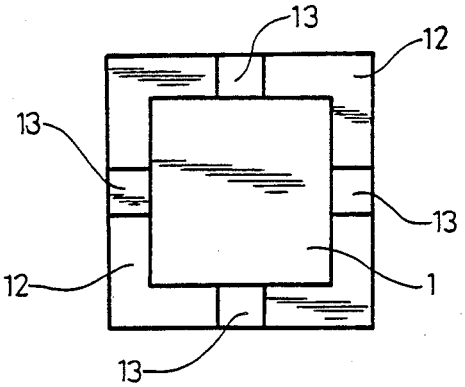
FIG. 4 is a bottom view of a single unit block in accordance with the present invention.

At first, this combining structure is applied to a single unit block 1 as shown in FIGS. 1, 2, 3 and 4. The single unit block 1 made of plastics, shaped hollow square, is provided with a cross-shaped tenon 11 on the top surface and walls 12 of the same depth extending downward at four sides. Each wall 12 is provided with a mortise 13 in the bottom surface corresponding to the cross-shaped tenon 11 and able to be tightly stuck in by the cross-shaped tenon of another block. Besides, the central lines of the cross-shaped tenon lap over those of the four mortises 13 and cross each other at the very center of the block 1.

Figure 5:
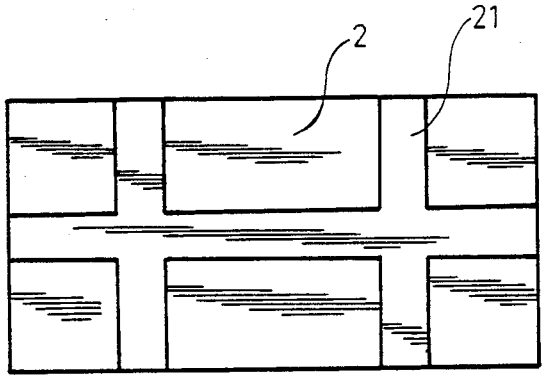
FIG. 5 is an upside view of a double unit block in accordance with the present invention.
Figure 6:
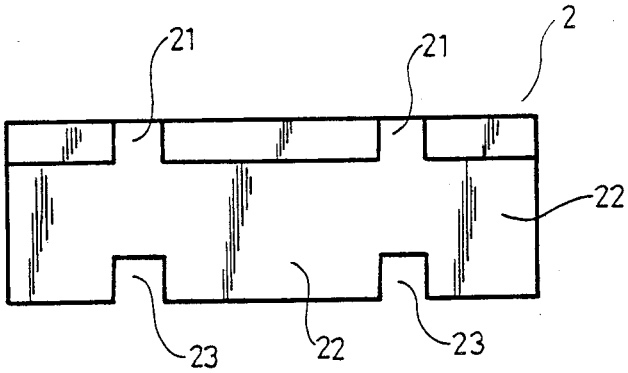
FIG. 6 is a front view of a double unit block in accordance with the present invention.
Figure 7:
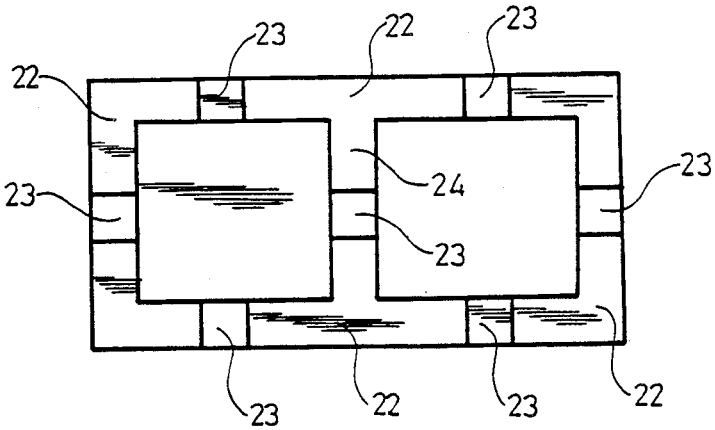
FIG. 7 is a bottom view of a double unit block in accordance with the present invention.
Figure 8:
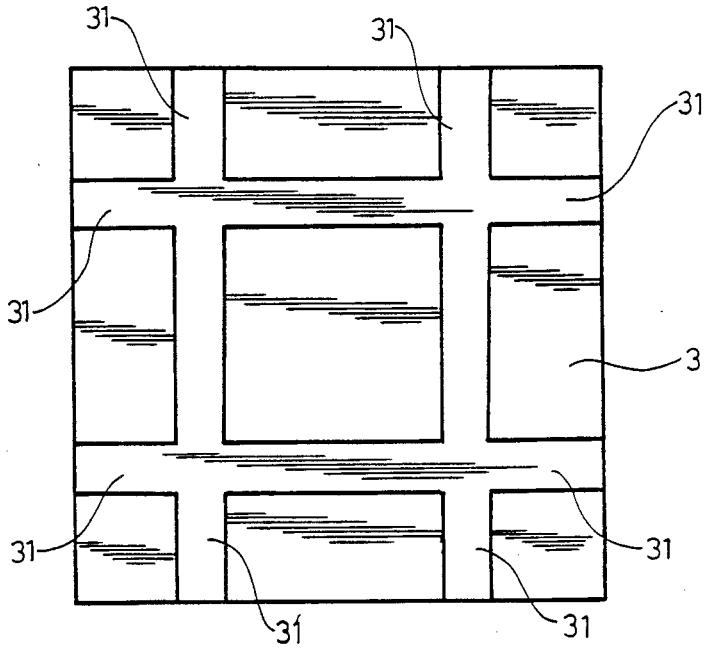
FIG. 8 is an upside view of a quodruple unit block in accordance with the present invention.
Figure 9:
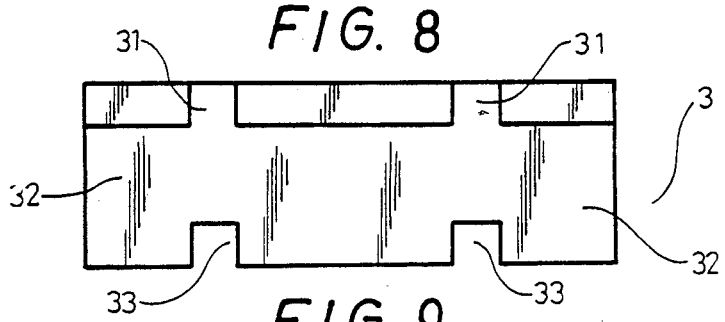
FIG. 9 is a front view of a quodruple unit block in accordance with the present invention.
Figure 10:
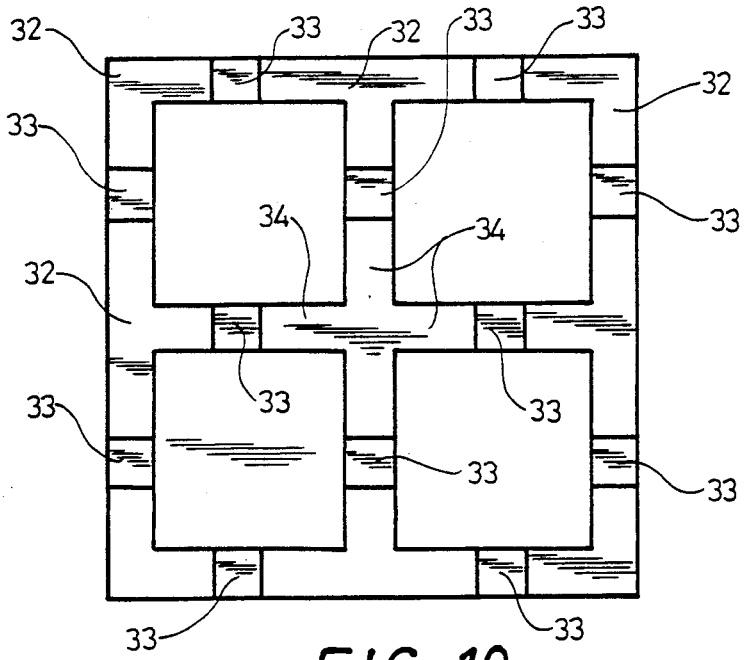
FIG. 10 is a bottom view of a quodruple unit block in accordance with the present invention.
Figure 11:
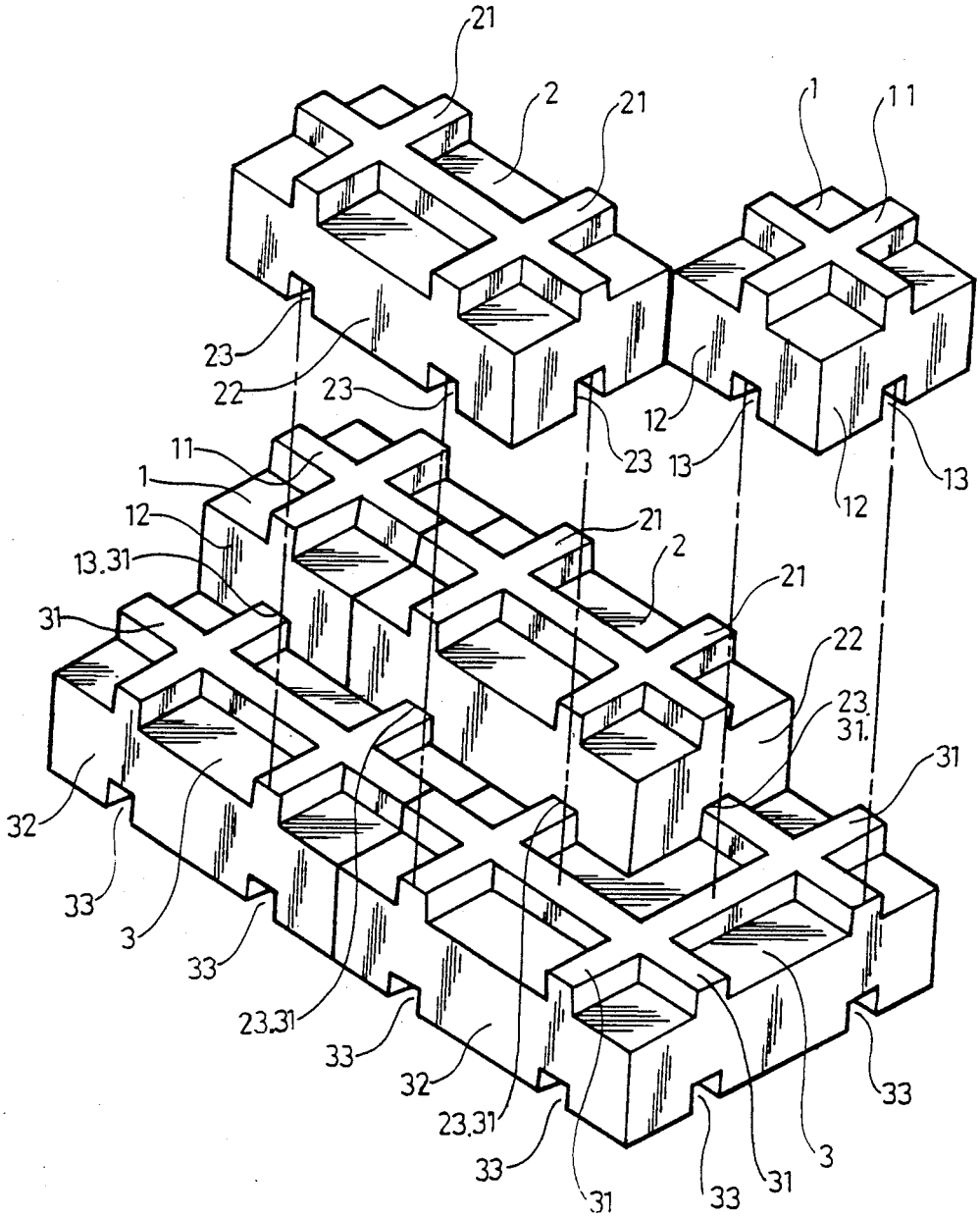
FIG. 11 is an example of the blocks combined together in accordance with the present invention.

Next, this combining structure is applied to a double unit block 2 as shown in FIGS. 5, 6 and 7. The double unit block is just two times larger as the single unit block 1, so the lengthwise section of the cross-shaped tenon 21, is continuous. Walls 22 also extend downward at four sides and a continuous wall 24 is formed between the two single unit blocks, and walls 22 and the continuous wall 24 are of the same depth and provided with a mortise 23 corresponding to the cross-shaped tenon 21, which can tightly stick in the mortises 23. The central lines of the mortises 23 also lap over those of the tenon 21.

Next, this combining structure is applied to a quodruple unit block 3, which is provided with a tenon 31 shaped as four crosses put together two side by side, walls 32 extending downward at four sides, a continuous wall 34 as deep as the walls 32, and a mortise 33 in each wall 32 or 34, corresponding to the tenon 31 and able to be stuck in by the tenon 31 of another block. In addition, the central lines of the mortises 33 lap over those of the tenon 31.

The main feature of the combining structure in accordance with the present invention is that every block, whether it is a single unit, a double unit, or a quodruple unit, is provided with a cross-shaped tenon of the same width on the top surface and mortises in the bottom surface corresponding to the tenon and having the same width as the tenon to be stuck therein by the tenon so that blocks can be combined together one by one continuously by sticking the tenon in the mortises.

The advantage of this combining structure is that the contact dimension of the tenons with the mortises are rather large so that they hardly break or wear off.

What is claimed is:

1. A combining structure for toy blocks, said combining structure comprising a single unit block made of plastics, at least two intersections formed by intersecting tenons on a top surface of said block, a wall extending downward on each of four sides of said block, at least one separate mortise in a bottom surface of each wall, at least two openings defined by said four walls and at least one separation wall to separate said openings and the openings extending to an underside of the top surface having said tenons so that the tenons of other blocks having similar structure as said single block unit tightly stick within the mortises of said walls, a number of said at least two openings being equal to a number of intersections of said intersecting tenons, and each separation wall between adjacent openings includes a mortise, said single unit block being able to be combined together one by one with other blocks by inserting the tenons in the mortises.

* * * * *